US005560490A

United States Patent [19]

Chawla

[11] Patent Number: 5,560,490

[45] Date of Patent: Oct. 1, 1996

[54] PHARMACEUTICAL PACKAGING WITH CAPSULE SEALING MEANS

[75] Inventor: Brindra P. S. Chawla, West Bridgford, England

[73] Assignee: FISONS plc, Suffolk, England

[21] Appl. No.: 397,186

[22] PCT Filed: Sep. 9, 1993

[86] PCT No.: PCT/GB93/01909

§ 371 Date: Mar. 27, 1995

§ 102(e) Date: Mar. 27, 1995

[87] PCT Pub. No.: WO94/05560

PCT Pub. Date: Mar. 17, 1994

[30] Foreign Application Priority Data

Sep. 9, 1992 [GB] United Kingdom ..... 9219113
Jul. 7, 1993 [GB] United Kingdom ..... 9314050

[51] Int. Cl.[6] ..... B65D 83/04; B65D 85/42

[52] U.S. Cl. ..... 206/539; 206/471; 206/529; 206/530

[58] Field of Search ..... 206/528, 529, 206/530, 531, 532, 539, 461, 471

[56] References Cited

U.S. PATENT DOCUMENTS

| | | | |
|---|---|---|---|
| 3,054,503 | 9/1962 | Hartman, Jr. et al. | 206/531 |
| 3,380,578 | 4/1968 | Sparks | 206/532 |
| 3,809,221 | 5/1974 | Compere . | |
| 4,161,516 | 7/1979 | Bell . | |
| 4,371,080 | 2/1983 | Haines | 706/531 |

FOREIGN PATENT DOCUMENTS

| | | |
|---|---|---|
| 0385156 | 9/1990 | European Pat. Off. . |
| 2232861 | 1/1974 | Germany . |

*Primary Examiner*—Bryon P. Gehman
*Attorney, Agent, or Firm*—Nixon & Vanderhye

[57] ABSTRACT

A medicament pack (1) comprising a base member (2) having a plurality of blisters (3) formed therein, each blister (3) being adapted to accommodate a medicament containing capsule (4), each capsule (4) being provided with at least one aperture (5) to permit medicament to be dispensed therefrom, wherein the base member (2) comprises sealing surfaces (6) adapted to seal the apertures (5).

10 Claims, 2 Drawing Sheets

PHARMACEUTICAL PACKAGING WITH CAPSULE SEALING MEANS

This invention relates to packaging for medicaments, in particular to packaging for pre-pierced capsules of inhalation medicaments.

The administration of inhalation medicaments in both liquid and dry powder forms are well known. Powdered inhalation medicament is often supplied in capsules which may be dispensed using e.g. the device known as the SPINHALER™. This device comprises a housing which retains an individual capsule of medicament, the capsule is pierced in situ thus releasing the medicament for inhalation. Such devices have the disadvantage that small fragments of the capsule may be produced during the piercing process which could be inhaled by the patient.

Pre-pierced medicament capsules, i.e. capsules the walls of which are provided with one or more apertures during manufacture, are known. However, during storage such capsules may leak medicament through the apertures and hygroscopic medicaments may take up water due to ingress of moisture into the capsules.

U.S. Pat. No. 3,809,221 describes a conventional blister-pack which has a childproof polymeric backing sheet, such a pack would be totally unsuitable for pre-pierced capsules since it does not have sealing means for the capsule apertures.

European Patent Application 0385156 (Phidea Srl) discloses a method of avoiding the problems associated with packaging pre-pierced capsules by providing a disposable inhaler containing a single pre-pierced capsule. However, this device suffers from the drawback that it may be necessary to carry several separate devices in order to provide a day's supply of medicament. It is also wasteful, since the device cannot be refilled and is thus discarded after only one use.

We have now devised an improved form of packaging for pre-pierced medicament capsules which is both effective and economical and which overcomes or substantially mitigates the problems described above.

According to the present invention, there is provided a medicament pack comprising a base member having a plurality of blisters formed therein, each blister accommodating a medicament containing capsule, each capsule being provided with at least one aperture to permit medicament to be dispensed therefrom, characterised in that the base number comprises sealing means adapted to seal the apertures.

The medicament pack according to the invention may be adapted to accommodate any practicable number of capsules, for example, enough to provide a day's, e.g. 4 doses, or a week's, e.g. 28 doses, supply of medicament for a patient.

The medicament packs according to the invention may be made by conventional techniques known for the formation of blister-packs. The base member may be made by thermoforming, e.g. by pressure forming or vacuum-drawing a heat-softened sheet of thermoplastic resin into a contoured mould. Once the base member has been cooled and removed from the mould, the medicament capsules may then be inserted into the blisters, e.g. mechanically or manually.

Conventional blister-packaging materials may be used to form the packaging according to the invention, e.g. polyvinyl chloride (PVC), PVC/polyethylene combinations, polystyrene and polypropylene. For improved moisture protection polyvinylidene chloride or polychlorotrifluoroethylene films may be laminated to PVC.

The sealing means provided in the base member are designed to prevent loss of medicament through the capsule apertures and also to minimise the ingress of moisture into the capsules. We prefer the sealing means to be formed in the walls of the blisters. When the sealing means are formed in the walls of the blisters they may be produced during the moulding of the base member as deseribed above.

The sealing means preferably comprise sealing surfaces adapted to seal the aperture containing portions of the capsules. Each sealing surface preferably has a profile which corresponds to the profile of the aperture containing portion of the capsule it is adapted to seal. For example, when the medicament capsule is cylindrical and has an aperture at formed at one or both ends, each sealing surface preferably comprises a circular concave surface embossed into the blister wall, this surface envelops and thereby seals the pierced end of the capsule.

Alternatively, the sealing means may take the form of tapered projections as adapted to sealably engage the apertures. The tapered projections fit into and plug the apertures.

The number of sealing means provided in the base member of the pack will obviously depend on the number of apertures provided in the capsules it is adapted to accommodate. However, we prefer the pack to be adapted to accommodate capsules having two apertures, we particularly prefer the pack to be adapted to accommodate cylindrical medicament containing capsules having an aperture formed at both ends.

We prefer the relative dimensions of the blisters and the medicament containing capsules said blisters are adapted to accommodate, to be such that the sealing means are urged into a sealing engagement with the capsules. For example, when the base member is adapted to seal cylindrical capsules having an aperture formed at both ends, we prefer the distance between the sealing means provided at both ends of each blister to be less than the distance between the pierced ends of the medicament containing capsule.

The blisters formed in the base member of the pack are preferably further provided with at least one resilient projection adapted to urge the medicament containing capsules into a sealing engagement with the sealing means. Each blister is preferably provided with two resilient projections, these being located on opposite sides of the blister. The resilient projections may take the form of shoulders formed in the walls of the blisters, said shoulders being adapted to bear on a capsule accommodated within the blister and thereby prevent significant movement of the capsule within the blister. The resilient projections may be formed in the walls of the blisters during the moulding of the base member as deseribed above.

The capsules to be packaged according to the invention may be made from any material in which apertures may be formed, suitable materials include hard or soft gelatin, polystyrene, nylons, polyalkylenes such as polyethylene, cellulose, alkyl cellulose and acetate polymers. The capsules may be of any shape, however, we prefer the capsules to be cylindrical.

The capsules may contain one or more apertures, e.g. 1 to 6, and especially 2 apertures. The apertures may be situated in any portion of the capsule, however, we prefer capsules in which an aperture is situated at the end of the capsule and more preferably at both ends of the capsule.

The capsule apertures may be of any shape, e.g. square, rectangular, oval, or preferably circular. When the apertures are circular they may have a diameter of between 0.50 and 1.20 mm, preferably from 0.50 to 1.01 mm, more preferably from 0.76 to 1.01 mm and especially 0.81 mm. When a capsule contains more then one aperture then the apertures may have the same or different dimensions.

The method used for forming the capsule apertures will be dependent upon the size, shape and position of the apertures, any conventional techniques known per se may be employed. When a circular or oval aperture is required a cutting or piercing tool may be used, alternatively LASER light may be employed or a hot needle. When a square or rectangular aperture is required a cutting tool with an inclined terminal face may be employed. The apertures may be formed in the capsules before or after they are filled with medicament, however, we prefer the apertures to be formed in the capsules after they have been filled with medicament.

The capsules to be packaged according to the invention will generally contain a unit dose of a medicament which is conventionally administered by inhalation to the lung or the nose. Such medicaments include drugs for use in the prophylactic or remedial treatment of reversible obstructive airways disease. Specific active ingredients which may be mentioned include salts of eromoglycic acid, e.g. sodium eromoglycate; salts of nedoeromil, e.g. nedoeromil sodium; inhaled steroids such as beclomethasone dipropionate, tipredane, budesonide and fluticasone; anticholinergic agents such as ipratropium bromide; bronchodilators, e.g. salmeterol, salbutamol, reproterol, terbutaline, isoprenaline and fenoterol, and salts thereof. If desired a mixture of active ingredients, for example, a mixture of sodium cromoglycate and a bronchodilator, such as salbutamol, reproterol, isoprenaline, terbutaline, fenoterol or a salt of any one thereof, may be contained in the capsules.

Other active ingredients that may be mentioned include antihistamines, e.g. clemastine, pentamidine and salts thereof, acetyl-β-methyicholine bromide; peptide hormones, e.g. insulin and amylin; bradykinin antagonists; $PLA_2$ inhibitors; PAF antagonists; lipoxygenase inhibitors; eukotriene antagonists; CNS active drugs, e.g. NMDA antagonists, glutamate antagonists, CCK agonists and antagonists; maerolide compounds, e.g. FK 506, rapamycin, cyclosporin and structurally related compounds; vitamins; vaccines, e.g. MMR vaccine and polio vaccine; and vectors for gene therapy, e.g. plasmids containing genes intended to correct genetic disorders such as cystic fibrosis.

The medicaments contained in the capsules to be packaged according to the invention will generally be in a form suitable for direct administration to a patient. The medicaments may comprise a particulate active ingredient in admixture with a solid pharmaceutically acceptable carrier. The carrier will generally be a non-toxic material chemically inert to the active ingredient but may, if so desired, also comprise larger particles of the active ingredient. Examples of carriers which may be used include a dextran, mannitol and, preferably, lactose. A particularly preferred carrier is crystalline lactose. Alternatively, the medicament may be a so-called "pelletised" composition, i.e. soft pellets comprising a plurality of individual particles of active ingredient loosely held together such that upon inhalation the pellets disintegrate to the constituent particles.

The open faces of the blisters in which the capsules are accommodated are preferably sealed by a removable cover sheet, e.g. a heat-sealable lidding material, which is attached to the base member. The cover sheet may be of either a push-through or peelable type. For a push-through type of pack, the cover sheet may comprise a heat-seal-coated aluminum foil. The coating on the foil must be compatible with the blister material to ensure satisfactory sealing both for product protection, e.g. to prevent the ingress of moisture and microorganisms, and for tamper resistance. For a peelable pack the cover sheet must also have a degree of puncture resistance and sufficient tensile strength to allow the cover sheet to be pulled away from the base member even when it is strongly adhered to it. Thus, for a peelable cover sheet a material such as polyester or paper may be used as a component of a foil lamination.

The invention will now be deseribed, by way of example only, with reference to the accompanying drawings, in which.

In the Figures, corresponding features of the alternative medicament packs are given the same reference numeral.

Figure 1:
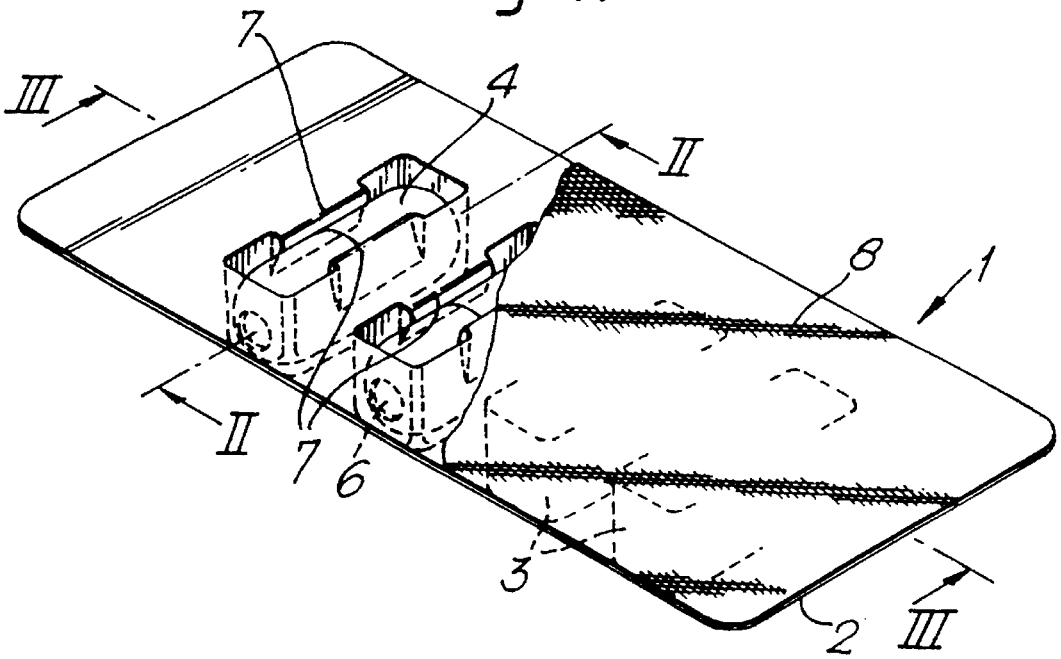
FIG. 1 is a perspective view of a medicament pack according to the invention (with cover sheet partially removed)
Figure 2:
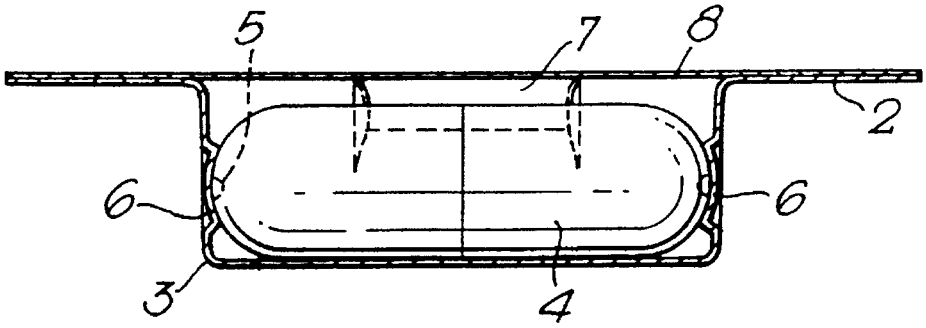
FIG. 2 is a sectional view along the line II—II of FIG. 1 (with cover sheet intact)
Figure 3:
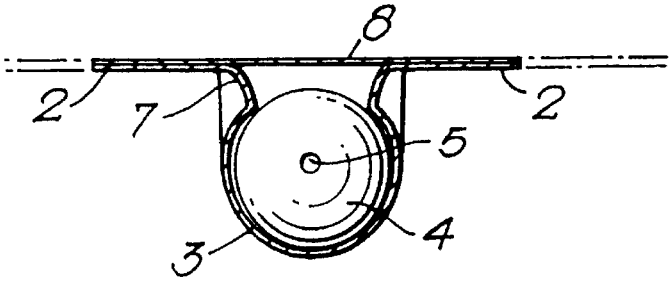
FIG. 3 is a sectional view along the line III—III of FIG. 1 (with cover sheet intact)

Referring firstly to FIGS. 1 to 3—a medicament pack (1) comprises a PVC base member (2) thermoformed to define four open faced blisters (3). Each blister (3) is shaped so as to accommodate a cylindrical medicament capsule (4) having a circular aperture (5) formed at both ends. Two circular sealing surfaces (6), each having a concave profile, are formed in the walls of each blister (3). The surface area of the sealing surfaces (6) being greater than the area of the apertures (5). These surfaces seal the pierced ends of the capsule (4) thus preventing loss of medicament through the apertures (5). The distance between the centre of the sealing surfaces (6) formed in any one blister (3) is slightly less than the length of the medicament capsule (4), such that surfaces (6) are urged into a sealing engagement with the pierced portions of the capsule (4). The capsules (4) are further urged into sealing engagement with surfaces (6) by shoulders (7) formed on opposite sides of each blister (3).

The open faces of the blisters (3) in base member (2) are sealed by a plastic/metal laminate cover sheet (8) which is heat-sealed to the surface of the base member (2). The cover sheet (8) may be peeled back to allow a capsule (4) to be removed from the pack prior to insertion in an appropriate inhalation device.

Figure 4:
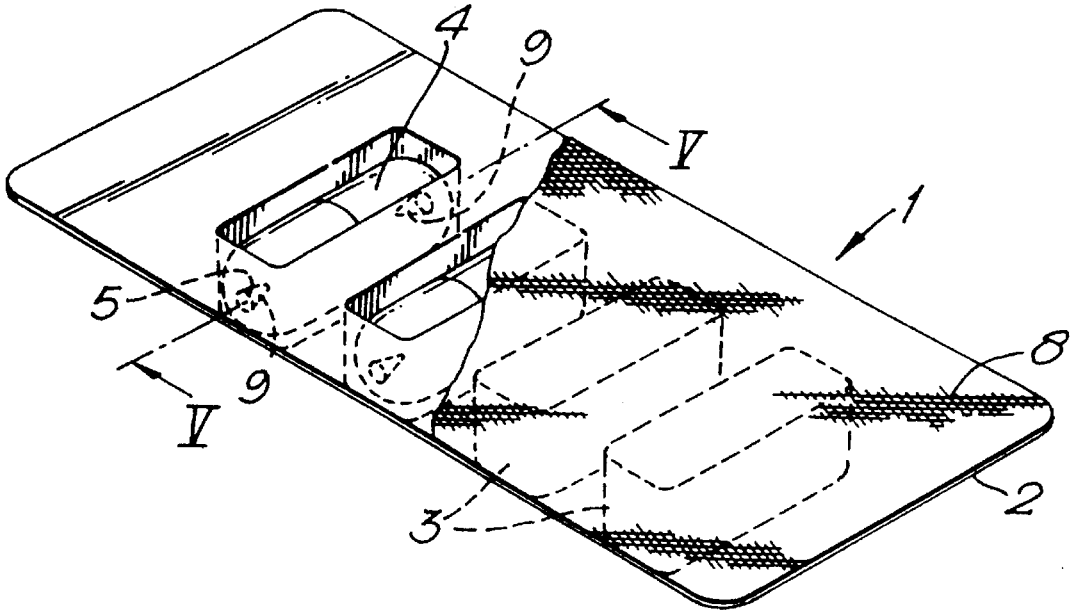
FIG. 4 is a perspective view of an alternative medicament pack according to the invention (with cover sheet partially removed)
Figure 5:
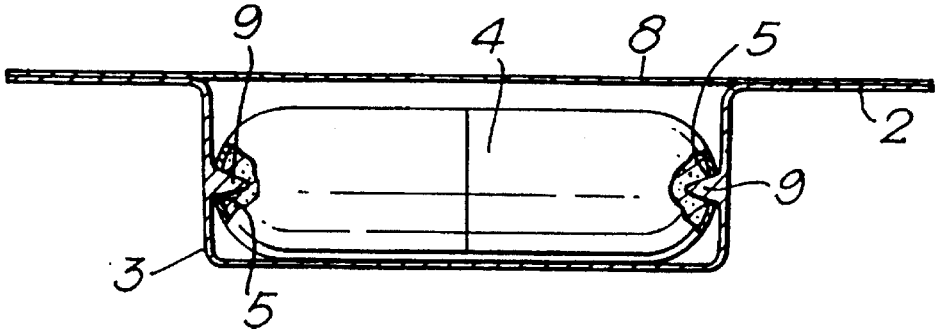
FIG. 5 is a sectional view along the line V—V of FIG. 4 (with cover sheet intact).

FIGS. 4 and 5 show an alternative medicament pack (1) comprising a PVC base member (2) thermoformed to define four open faced blisters (3). Each blister (3) is shaped so as to accommodate a cylindrical medicament capsule (4) having a circular aperture (5) formed at both ends. Tapered projections (9) formed in the walls of each blister (3) fit into and sealably engage the capsule apertures (5). The distance between the bases of the projections (9) formed in any one blister (3) is slightly less than the length of the medicament capsule (4), such that projections (9) are urged into a sealing engagement with the capsules (4).

The open faces of the blisters (3) in base member (2) are sealed by a plastic/metal laminate cover sheet (8) which is heat-sealed to the surface of the base member (2). The cover sheet (8) may be peeled back to allow a capsule (4) to be removed from the pack prior to insertion in an appropriate inhalation device.

I claim:

1. A medicament pack comprising a base member having a plurality of blisters formed therein, each blister accommodating a medicament containing capsule, each capsule being provided with at least one aperture to permit medicament to be dispensed therefrom, said base member comprising sealing means for sealing said at least one aperture.

2. A medicament pack according to claim 1, wherein the sealing means are formed in walls of the blisters.

3. A medicament pack according to claim 2, wherein the sealing means comprise sealing surfaces for sealing an aperture containing portion of the capsules.

4. A medicament pack according to claim 3, wherein each sealing surface has a profile which corresponds to the profile of the aperture containing portion of the capsule it is adapted to seal.

5. A medicament pack according to claim 2, wherein the sealing means comprise tapered projections which sealably engage said at least one aperture.

6. A medicament pack according to claim 1, wherein the blisters accommodate cylindrical capsules containing medicament having at least one aperture formed at both ends.

7. A medicament pack according to claim 1, wherein the relative dimensions of the blisters and the medicament containing capsules accommodated in said blisters, are such that the sealing means are urged into a sealing engagement with the capsules.

8. A medicament pack according to claim 1, wherein each blister is further provided with at least one resilient projection which urges the medicament containing capsules into a sealing engagement with the sealing means.

9. A medicament pack according to claim 1, wherein the base member is provided with a sufficient number of blisters to accommodate one day's supply of medicament containing capsules for a patient.

10. A medicament pack according to claim 1, wherein the blisters are sealed by a removable cover sheet attached to the base member.

* * * * *